US005107997A

United States Patent [19]

Worsley

[11] Patent Number: 5,107,997

[45] Date of Patent: Apr. 28, 1992

[54] CABLE MACHINE CONTROL

[75] Inventor: Ralph S. Worsley, Vancouver, Canada

[73] Assignee: MacMillan Bloedel Limited, Burnaby, Canada

[21] Appl. No.: 646,486

[22] Filed: Jan. 28, 1991

Related U.S. Application Data

[63] Continuation of Ser. No. 391,962, Aug. 10, 1989, abandoned.

[51] Int. Cl.[5] ..... B66C 13/14

[52] U.S. Cl. ..... 212/89; 212/90; 212/91; 212/163; 212/164; 414/2; 37/DIG. 1

[58] Field of Search ..... 212/71-121, 212/163, 164; 414/917, 2; 37/DIG. 1, 135-136, 183 R; 200/6 A, 18; 340/688; 364/474.09, 478

[56] References Cited

U.S. PATENT DOCUMENTS

| | | | |
|---|---|---|---|
| 3,051,326 | 8/1962 | Brandt | 212/174 |
| 3,293,381 | 12/1966 | Eitel | 200/6 A |
| 3,407,942 | 10/1968 | McIntyre et al. | 212/89 |
| 3,427,902 | 2/1969 | Smith | 212/174 |
| 3,436,056 | 4/1969 | Thompson | 212/89 |
| 3,523,614 | 8/1970 | Walker | 212/164 |
| 3,523,615 | 8/1970 | Anderson et al. | 212/98 |
| 3,543,946 | 12/1970 | McIntyre et al. | 212/91 |
| 3,707,093 | 12/1972 | Warden | 200/6 A |
| 3,723,687 | 3/1973 | Adkinson | 200/6 A |
| 3,831,772 | 8/1974 | Jorgenson | 212/84 |
| 3,870,161 | 3/1978 | Cording | 212/164 |
| 4,756,655 | 7/1988 | Jameson | 414/917 |

FOREIGN PATENT DOCUMENTS

| | | | |
|---|---|---|---|
| 2062766 | 6/1972 | Fed. Rep. of Germany | 212/164 |
| 14328 | 1/1986 | Japan | 37/DIG. 1 |
| 94622 | 5/1987 | Japan | 37/DIG. 1 |
| 63-829 | 3/1988 | Japan | 37/DIG. 1 |
| 142129 | 6/1988 | Japan | 37/DIG. 1 |
| 456482 | 1/1977 | U.S.S.R. | 212/164 |

OTHER PUBLICATIONS

Washington Iron Works; Model 108, "Skylok" Yarder; two pages (sides 1 and 2).

*Primary Examiner*—Sherman Basinger
*Assistant Examiner*—Thomas J. Brahan
*Attorney, Agent, or Firm*—C. A. Rowley

[57] ABSTRACT

Cable machine control, particularly a grapple yarder is provided with an integrated control system whereby the operator is provided with controls each of which controls a desired operation or movement of the grapple. In particular the controls include a haul back and an in direction control, an up and down control and an opening and closing control some of which may be operated simultaneously with the speed of any operation or movement dependent on the maximum displacement of the control for any selected operation or movement.

1 Claim, 5 Drawing Sheets

100
138
140
122
104
112
106
102
32
MAIN DRIVE POWER CONTROL (TORQUE-THROTTLE)
142
IN
146
16,24
HAUL BACK DRIVE
150
BACK
148
156
UP
152
34
HAUL BACK BRAKE
MAIN COMPUTER CONTROL
DOWN
154
162
158
OPEN
OPENING DRIVE
18,26
CLOSE
160
SWING RIGHT
164
OPENING BRAKE
36
SWING LEFT
166
20,28
CLOSING DRIVE
144
38
BOOM SWING
CLOSING BRAKE
22,30

CABLE MACHINE CONTROL

This application is a continuation of application Ser. No. 07/391,962, filed Aug. 10, 1989 now abandoned.

FIELD OF THE INVENTION

The present invention relates to a control system. More particularly the present invention relates to a cable operated machine control system wherein separate controls are provided to obtain discrete operations or movements of the working element.

BACKGROUND OF THE PRESENT INVENTION

In cable operated equipment particularly grapple yarders, the operator must become extremely skilled to properly and rapidly manipulate the grapple or working element to engage and move the logs or the like.

There are three main varieties of the basic grapple yarder type equipment. Each variation incorporates a main crane structure and a grapple suspended by cables between the main crane structure and a back spar. Each also includes a main line and a haul back line. The main line connects directly to the grapple mechanism and is used to move the grapple towards the crane and to close the grapple. The haul back line passes through the pulley on the back spar and then to the grapple and is used to move the grapple out, i.e. away from the crane. By adjusting the tension in the main line and the haul back line the sag in the lines is increased or descreased and the grapple can be raised or lowered.

The variations include the use of twin main lines wherein a second main line is used to open the grapple. In this arrangement each of the main lines uses an individually controlled winch having an on/off clutch connected to the drive and a controlled variable friction water cooled brake. When hauling the grapple in toward the crane brakes on these winches are released and the clutches engaged while tension is maintained by application of a hold back brake and the speed is regulated by the engine throttle. To haul the grapple out, these main clutches are disengaged and the main brakes applied to adjust line tension and thus the sag of the lines and at the same time the haul back clutch is engaged to activate the haul back winch to draw in the haul back line and move the grapple out, away from the crane. Opening and closing of the grapple is obtained by relative movement between the two main lines which are sometimes named as the opening and closing main lines.

In another form of machine, the opening main line is replaced by a smaller diameter tag line whose prime function is to open the grapple. The tag line winch is driven by a variable friction water cooled clutch to haul in the tag line or resist to it being pulled out thereby maintaining a tension in the tag line. The grapple is opened by increasing the tension in the tag line above that of the main line (by tag line clutch, main line clutch and/or brake manipulation).

The third variation incorporates two main lines driven at the same speed, one of which is designated an opening line, passes through a line shortener so that the opening line may be selectively shortened by operating the line shortener to thereby open the grapple.

All machines are provided with locking brakes normally air operated to lock all the winches for example, for parking.

The cab, boom, winches, drive, etc. of the crane are all mounted from a platform that is rotatable in opposite directions via a swing left or a swing right clutch driven by the main motor to swing the boom, cab, etc. to the left or right respectively.

The control systems currently available for this equipment require individual direct manual control of each of the various drive clutches or brakes and for the operator to selectively engage and/or disengage clutches and/or brakes to obtain the desired operation or direction of movement of the operating element or grapple. Thus in current machines such as a grapple yarder having a haul back cable drive, a closing main cable drive and an opening main cable drive, each with its own brakes and clutch, the operator is required to select and directly control each of the drives and each of the brakes independently and to adjust the throttle or power source to obtain the desired rate of change. For example to move a grapple in requires that the operator simultaneously activate both opening and closing drives (in tag machine only the closing drive is controlled) and disengage the opening and closing brakes, partially releasing the haul back brake to apply the desired drag to the haul back cable and adjust the throttle to obtain the desired rate of movement. In such a double main line grapple yarder, the operator, in manipulating the grapple, must coordinate the movement of three levers, two joysticks, three pedals and a knee control. Obviously this requires a significant amount of physical and mental effort sometimes very rapidly when transferring from one direction to another and to control the movement and operation of the grapple. Obviously excessive mental and physical effort leads to fatigue reducing the effectiveness of the operator. Also, to become a proficient operator takes a significant amount of training time.

Integrated computer operated controls have been used on a variety of different equipment however, prior to the present invention no integrated manual control system has successfully been applied to a cable operated machine such as a grapple yarder.

BRIEF DESCRIPTION OF THE PRESENT INVENTION

It is an object of the present invention to provide a control system for a cable operated machine wherein the operator directs movement or operation of the operating element via a control for each such movement or operation.

Broadly the present invention relates to a cable operated machine comprising a working element, a haul back cable connected to said working element, a haul back drive means for said haul back cable, a haul back drive control means, brake means for said haul back cable, a haul back brake control means, an opening cable and a closing cable, an opening drive means for said opening cable, an opening drive control means for said opening drive means, a closing drive means for said closing cable, a closing drive control means for controlling said closing drive means, a closing cable brake means, a closing cable brake control means for controlling said closing cable brake means, said opening cable and said closing cable connected to said working element to move said element in a first direction when said closing drive means is operative, said haul back cable when said haul back drive means is operating moving said working element in a second direction generally opposite to said first direction, a throttle control adapted to adjust the amount of torque available to all of said drive means; a manual controller having an in control actuatable to provide an in signal for moving said working element in said first direction, a haul back control to provide haul back signal for moving said working element in said second direction, an up control to provide an up signal for raising said working element, a down control to provide a down signal to lower said working element, an opening control means to provide an open signal to open said working element, and a closing control to provide a close signal to close said working element; a main computer means, said main computer means receiving said signals from said controller and programmed to control operation of said cable operated machine in accordance with said received signals; said main computer means activating said haul back drive, disconnecting said haul back brake and adjusting said closing brake means to adjust a drag force applied by said closing brake resisting said haul back drive when said computer means receives a haul back signal thereby to haul back said working element in said second direction, adjusting a throttle control to adjust the speed of said working element in said second direction in accordance with the degree of displacement of said haul back control; said main computer means disengaging said closing brake and activating said closing drive means when said main computer receives an in signal and adjusting said throttle control means to adjust torque to said closing drive means in accordance with the degree of displacement of said in control; said main computer means controlling said brakes and drives to extend the length of cable between said drives and said working element when said main computer means receives a down signal and operating said drives and said brakes to shorten lengths of said cables between said drives and said working element when said main computer means receives an up signal, said main computer means controlling the length of said cables between said element and said drives to control the height of said working element in accordance with the manipulation of said up and down controls and controlling the rate of lengthening or shortening of said cables in accordance with the degree of displacement of said down and up controls respectively, said main computer control means causing relative displacement of said opening and said closing cables to open or close said working element when said main computer means receive an open or a close signal.

In one embodiment of the present invention, the control system is applied to a two or double main cable operated machine and further includes an opening brake means for said opening cable and an opening brake control means for said opening brake means and wherein said computer control means controls said opening brake control means to control said opening brake in accordance with signals received from said controller.

BRIEF DESCRIPTION OF THE DRAWINGS

Further features, objects and advantages will be evident in the following detailed description of the preferred embodiments of the present invention taken in conjunction with the accompanying drawings in which.

DESCRIPTION OF THE PREFERRED EMBODIMENTS

Figure 1:
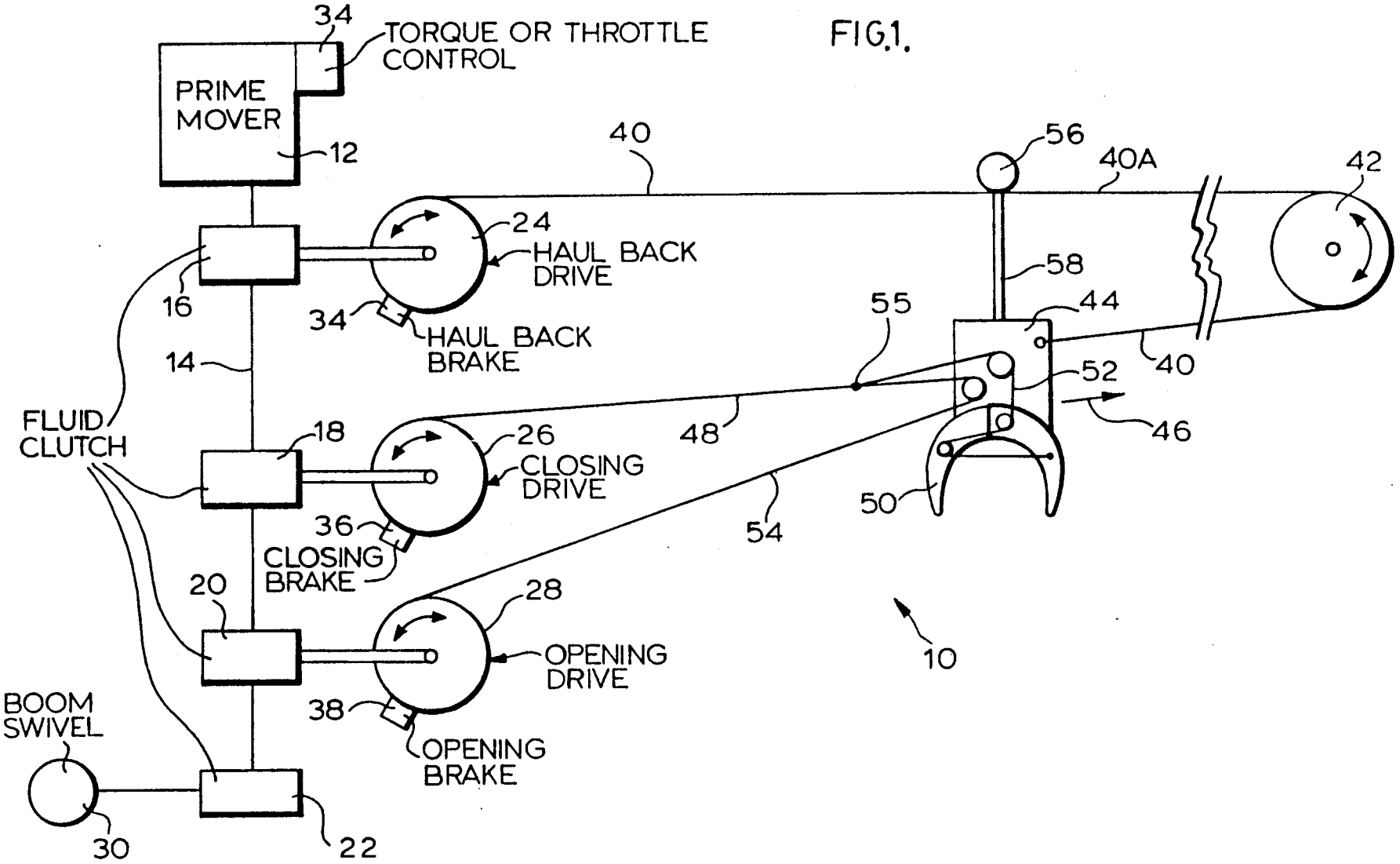
FIG. 1 is a schematic illustration of a cable operated machine into which the present invention may be incorporated.
Figure 2:
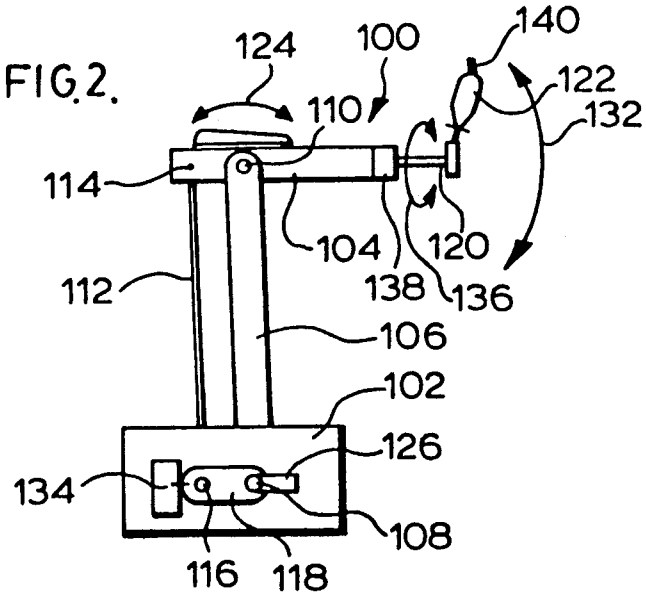
FIG. 2 shows a controller having separate signal generating means for generating the required control signals.

FIG. 1 schematically illustrates a two main line cable operated system 10 such as that used for grapple yarding of logs. The two main line (cable) machine is the most complicated of the three variations of the grapple yarder as described above and thus the control will be described for this type of machine which incorporates separate opening and closing drives each of which is provided with its own brake.

The system 10 includes a prime mover such as a diesel engine 12 adapted to provide power via a common drive which for simplicity has been illustrated as a shaft 14. Clutches 16, 18, 20 and 22 couple the haul back drive 24, closing drive 26, opening drive 28, or cab and boom platform swing drive 30 respectively to the prime mover 12. (Only a single boom swing drive clutch 22 has been shown but in many machines two such clutches are provided; one to initiate clockwise rotation of the platform and the other to obtain counterclockwise rotation of the platform.) The prime mover 12 is provided with a torque or throttle control 32 that governs the amount of energy available and thus the power or speed of the shaft 14.

The various drives, namely the haul back drive 24, closing drive 26 and opening drive 28 are each coupled to the prime mover shaft 14 through their respective selectively actuated haul back, closing and opening clutches 16, 18 and 20. Each drive 24, 26 and 28 is also provided with a brake, namely a haul back brake 34, a closing brake 36 and an opening brake 38 respectively. A haul back cable 40 passes from the haul back drive 24 around a return pulley 42 and connects with a working element 44 which in the illustrated system is a grapple 44 so the tension in the line 40 draws the grapple 44 in the haul back direction as indicated by the arrow 46. The closing drive 26 has a cable 48 connected to the grapple element 50 via an extension cable 52 and the opening drive 28 has a cable 54 that is connected to cable 48 as indicated at 55. The grapple element 50 may be opened and closed by shifting the cables 48 and 54 and thus the position of the joint 55 toward and away from grapple 44. Movement of joint 55 toward the grapple extends the available length of cable 52 and opens the grapple element 50.

The grapple 44 is slung from the outgoing section 40A of the cable 40 via a pulley 56 that rides on the section 40A of the cable 40 and a suspension cable 58.

A suitable controller for controlling the operation of the various drives and brakes is illustrated in FIGS. 2 to 6 inclusive. Controller 100 is mounted on the base 102 and is composed of a control arm 104 supported on a support link 106 pivoted on the base as indicated at 108 and to the arm as indicated at 110. A suitable bar 112 forms a parallel link with the link 106 and is pivotably connected at one end as indicated at 114 to the bar 104 and at the opposite end 116 to a link 118 which in turn is pivotably mounted on pivot 108 so that the arm 104, link 106, link 118 and bar 112 form a parallelogram.

Figure 3:
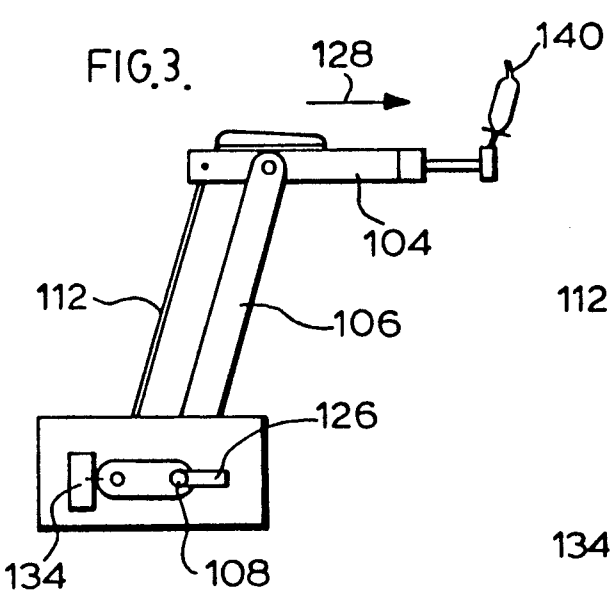
FIG. 3 is a view of the controller of FIG. 2 moved to a haul back position.
Figure 4:
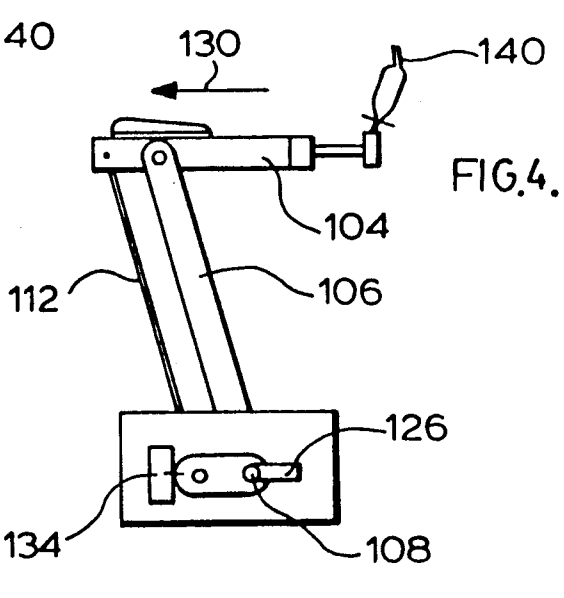
FIG. 4 is a view of the controller moved into in position.
Figure 6:
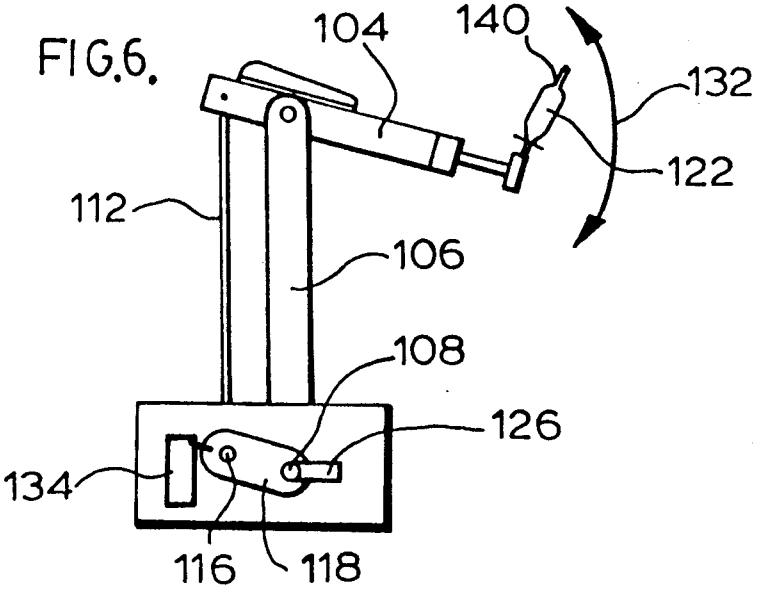
FIG. 6 shows the controller in down position.
Figure 5:
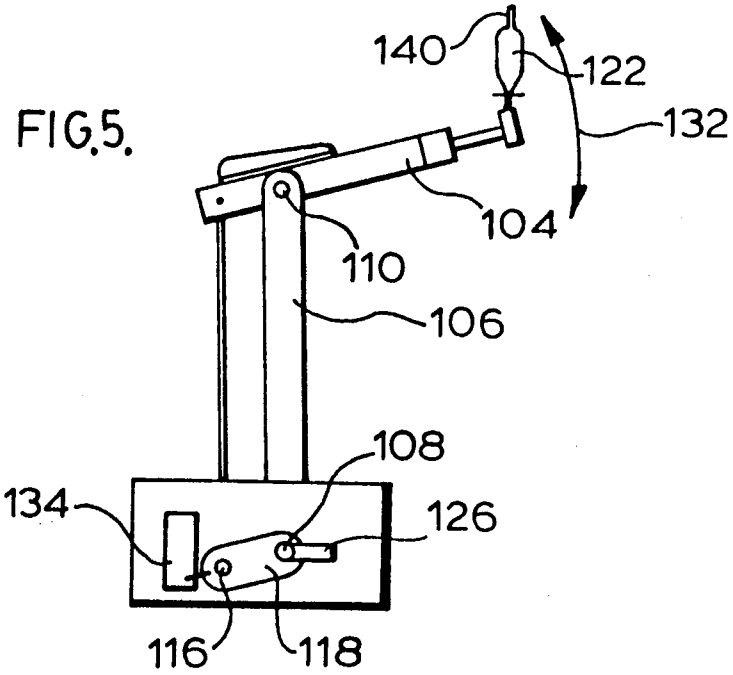
FIG. 5 shows the controller in up position.

Projecting axially from the bar 104 is shaft 120 on which is mounted a hand grip 122. The arm 104 may be moved as indicated by the arrow 124 around the pivot 108. The degree of displacement is measured via the sensor 126 which senses the horizontal displacement of the arm 104 based on its rotation around the pivot 108. For example, as shown in FIG. 3 and 4 the arm 104 and link 106 are pivoted around pivot point 108 in a forward direction as indicated by the arrow 128 which results in the haul back drive 24 moving the grapple 44 in the direction of the arrow 46, i.e. towards the pulley 42. Movement of the arm 104 and link 106 in the opposite direction as indicated by the arrow 130 (FIG. 4) deactivates the haul back drive and activates the opening (26) and closing (28) drives through the clutches 18 and 20 respectively as required to move the grapple 44 away from the pulley 42, i.e. in the opposite direction to the arrow 46.

It will be noted that in the FIGS. 3 and 4 illustrations the arm 104 remains substantially horizontal and is simply displaced in a horizontal direction as indicated by the arrows 128 and 130 by pivoting around the pivots 108 and 110. The link 112 maintains a parallel relationship with the link 106, and the arms 104 and link 118 maintaining their parallel horizontal relationship so that the pivot point 116 does not move up or down.

The grapple 44 is moved up or down by pivoting the arm 104 around the pivot point 110 as indicated by the arrow 132. Such pivotal movement around pivot 110 also causes the link 118 to pivot around pivot point 108 and thus move the pivot 116 down. Movement of pivot 116 is sensed by the sensor 134 which generates an up signal for movement up when the arm 104 is moved up (e.g. the position of FIG. 5) or a down signal when moved down (e.g. the position of FIG. 6).

To rotate the boom (not shown) via the boom swing drive 30, the handle 122 is rotated around the axis of the shaft 120 as indicated by the arrow 136. Rotation of the axle 120 relative to the arm 104 is sensed by the sensor 138 that sends a signal to activate the clutch 22 to drive the boom swivel 30 in the appropriate direction. The machine, i.e. boom, drives, clutches, power generator and operator are all on a common platform that rotates to rotate the boom.

Horizontal displacement of the arm 104 in either the direction 128 or 130 adjusts the throttle or torque control 32 to increase the amount of torque available in drive 14. Similarly movement as indicated by the arrow 132 adjusts the throttle 32 as does movement as indicated by the arrow 136. In all cases the major demand for power, i.e. maximum displacement will govern the setting of throttle 32 however this setting will be further influenced if two controls are actuated simultaneously. For example, if the grapple is to be lifted and moved in the direction opposite to the direction of the arrow 46 the control arm 104 will be moved in the direction of the arrow 130 to obtain movement opposite to the arrow 46 (in FIG. 4) and at the same time pulled upwardly as indicated by the arrow 132 in FIG. 5 by shortening the length of the cables to the working element. Displacement of the arm 104 in any direction of the arrow 130 would normally result in a particular adjustment of the throttle 32. Similarly movement of the arm 104 upward as indicated by the arrow 132 in FIG. 5 would also normally result in a certain setting for throttle 32. Whichever of the above movements, i.e. in the direction of the arrow 130 or in the direction of the arrow 132 would result in the higher torque setting for the throttle 32 and the throttle will be adjusted accordingly. If desired the computer 144 (to be described below) may be programmed to add to this higher setting a further throttle increment based on an increment in proportion to the displacement of the control 100 in the direction demanding the lower throttle setting.

Obviously all controls could be implemented simultaneously and the computer programmed so each of the lower throttle demand signals provides preselected increment increases in throttle setting.

Open or close command signals are provided by separate open and close buttons or for example a simple three position toggle switch to provide and open signal, a close signal or no signal. Such a toggle switch may be positioned as indicated at 140 on top of the handle 122.

Figure 7:
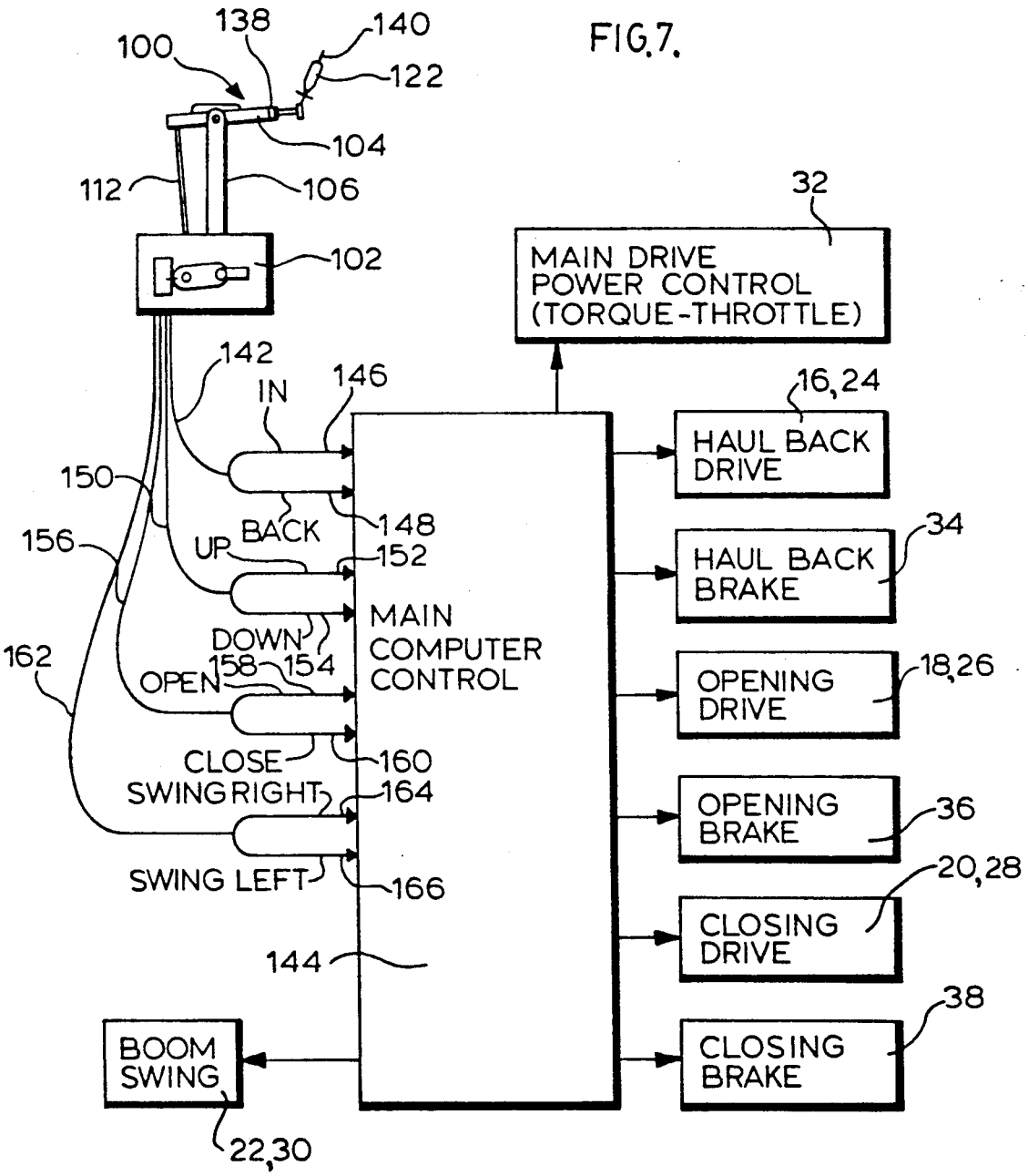
FIG. 7 is a schematic illustration of the computer control system of the present invention.

As indicated in FIG. 7, the signal from the sensor 126 is fed via line 142 to the main computer 144 to provide an in or a haul back signal as indicated at 146 and 148 respectively.

The sensor 134 provides the computer 144, via line 150, an up signal 152 or a down signal schematically indicated at 154. The line 156 delivers an open signal schematically represented at 158 or a close signal 160 from the toggle switch 140 and the sensor 138 delivers via line 162 a swing right signal (clockwise) signal 164 or a swing left (counterclockwise) signal 166 to the computer 144.

The computer 144 analyzes the signals and controls the main drive power control or throttle 32, the haul back drive via the clutch 16, the haul back brake 34, the main or closing drive 26 via clutch 18, the opening brake 36, the second main or opening drive 28 via clutch 20 and the opening brake 38. The computer 144 also controlled the boom swing 30 via the clutch 22 (if desired the boom swing may also be provided with a boom brake that would likewise be controlled by the main computer control 144). The operation of the main computer control to control the various operations is summarized in Table 1 and will be described now in respect to the schematic illustration of FIG. 8.

TABLE 1

| | | Preferred System | | An Alternative System (Further Alternative) | |
|---|---|---|---|---|---|
| Grapple Movement | Drives or Brakes | Drive Condition | Brake Condition | Drive Condition | Brake Condition |
| In and Out (Haul Back) Control | | | | | |
| In | Haul Back | Off | Drag | | |
| | Opening | On | Off | | |
| | Closing | On | Off | | |

Control displacement adjusts speed of operative drives (opening and closing)

TABLE 1-continued

| Grapple Movement | Drives or Brakes | Preferred System: Drive Condition | Preferred System: Brake Condition | An Alternative System (Further Alternative): Drive Condition | An Alternative System (Further Alternative): Brake Condition |
|---|---|---|---|---|---|
| through throttle control and adjust drag by varying pressure to the haul back brake. The drag is also determined by the desired height of the working element. | | | | | |
| Haul Back | Haul Back | On | Off | | |
| | Opening | Off | Drag | | |
| | Closing | Off | Drag | | |
| Control displacement adjusts speed of operative drive and drag applied via closing and opening brakes. The drag also governs the height of the working element. | | | | | |
| Up and Down Control per se | | | | | |
| Up Per Se | Haul Back | On | Off | Off (on) | Locked (off) |
| | Opening | Off | Locked | On (on) | Off (off) |
| | Closing | Off | Locked | On (on) | Off (off) |
| Control displacement adjusts speed of operative device through throttle control. | | | | | |
| Down Per Se | Haul Back | Off | Drag | Off (off) | Drag (locked) |
| | Opening | Off | Drag | Off (off) | Locked (drag) |
| | Closing | Off | Drag | Off (off) | Locked (drag) |
| Control displacement adjusts drag applied by activated brakes. | | | | | |
| Open and Close Control per se | | | | | |
| Open | Haul Back | Off | On | Off | On |
| | Opening | On | Off | Off | On |
| | Closing | Off | On | Off | Off |
| Control displacement adjusts speed of operative drive through throttle control when the closing drive is on. | | | | | |
| Close | Haul Back | Off | On | Off | On |
| | Opening | Off | On | Off | Off |
| | Closing | On | Off | Off | On |
| Control displacement adjusts speed of operative drive through throttle control. | | | | | |
| In and Up | | | | | |
| Simultaneous | Haul Back | Off | Drag increased | | |
| | Open | On | Off | | |
| | Close | On | Off | | |
| Displacement of control increases throttle and the speed of open and close drives primarily dependent on the control displacement that is the greater and increases the drag above that normally applied to haul back brake 34 at a rate in proportion to the displacement of control 100 in the Up direction, i.e. in the direction of the arrow 132 until the desired height is reached and the Up direction control moved to neutral position. | | | | | |

Figure 8:
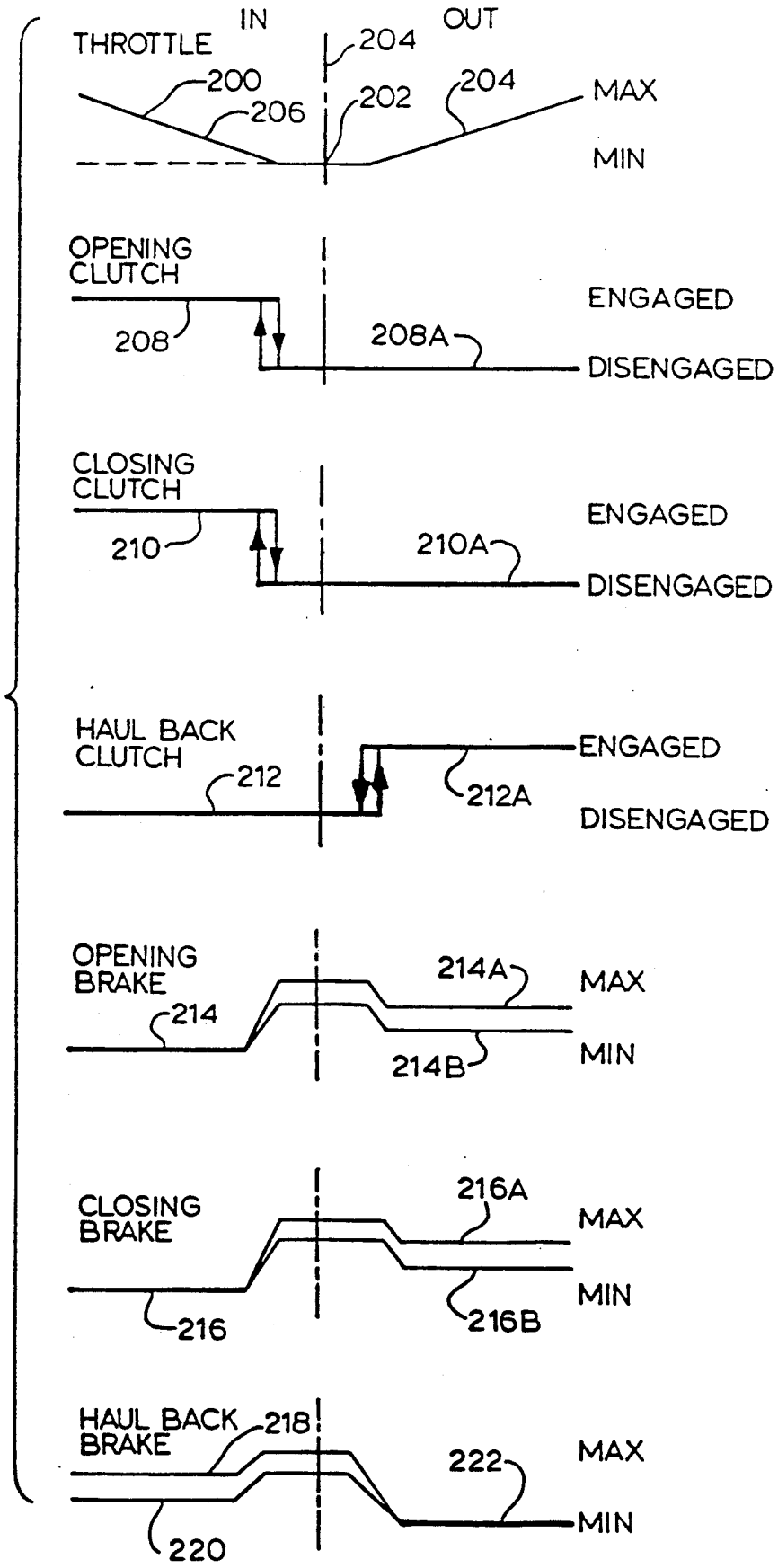
FIG. 8 is a graphic representation of the operation of the various drive and brake elements of the cable operated equipment.

As indicated in FIG. 8, the throttle control as indicated by the line 200 has a neutral position 202 and increases after a preset displacement in either direction, i.e. in the in direction to the left of the neutral or centre line 204, i.e. in the haul back direction which obtains movement of the working element 44 in the direction of the arrow 46 in FIG. 1 or in a direction to the right of line 204 to move the working element 44 in the opposite or in direction. The sloping parts 206 which are mirror images on the curve 200 indicate the increase in throttle as directly dependent on displacement or haul back or in controls.

Movement in the in direction causes engagement of the closing clutch (assuming that the grapple is now moving inwardly with the log the grapple must be closed as indicated by the engaged line 210). Similarly the opening clutch is also engaged at indicated by line 208 so that the line or cables 48 and 54 are drawn in toward the closing and opening drives 26 or 28 respectively so that both cables 48 and 54 share the load to drive the working element 44 in. The relative positions of these cables 48 and 54 determine whether the grapple 50 is open or closed. Obviously under these conditions the haul back clutch 16 must be disengaged as indicated by the line 212. The opening and closing brakes 36 and 38 are disengaged as indicated by the line 214 and 216 respectively.

The pressure on the haul back brake 34 has been indicated by two sets of substantially horizontal curves 218 and 220 indicating that the pressure or back pressure (tension) applied via the haul back brake to the cable 40 is different depending on the height of the grapple (higher pressure greater drag the higher the grapple under stable conditions).

The control of the opening and closing clutches is in part regulated by the toggle switch 140. If the closing switch 140 is in the open position when the grapple approaches the boom, the closing clutch is disengaged before the opening clutch thereby to open the grapple. To close the grapple and pick up a log the switch 140 will be in the close position activating the closing clutch before the opening clutch to close the grapple before the grapple is moved in the direction opposite to the arrow 46.

When the haul back drive 24 is activated throttle control acts as above described and follows the curve 206. Both the opening and closing clutches 18 and 20 are disengaged as indicated by the curves or lines 208A or 210A respectively and the haul back clutch 16 is engaged as indicated by the line 212A. The opening and closing brakes 36 and 38 are each designated by two curves 214A and 214B and 216A and 216B respectively which indicate that both brakes are both applied and the degree of applied pressure to the brakes is dependent on the desired height of the grapple. The curves 214A and 216A simply indicate a different brake setting than the curves 214B and 216B whereby the tension in the cable system is changed and thus the height of the grapple changed.

The haul back brake obviously must be disengaged as indicated by the line 222 when the working element 44 is moved in the direction of arrow 46.

It will be apparent from Table 1 and from a review of FIG. 8 that displacement of the control to opposite sides of the neutral position as indicated by centre line 204 and the horizontal section of the curve 202 automatically results in operation of the various brakes and clutches and adjustment of the throttle setting to obtain the desired movement of the working element 44.

The above description has dealt with systems wherein two main lines, i.e. both the opening and closing lines act as driving lines to pull the grapple in towards the unit. In a tag line system wherein a tag line position is used simply to open and close the grapple, the tag line is maintained substantially constant relative to that of the main line except when it is desired to open and close the grapple thus the tag line is reeled in at essentially the same rate as the main line or fed off at essentially the same speed as the main line with the rate of feeds being changed by adjusting the drive to the tag line drum to relatively displace the two cables and cause selected opening and closing of the grapple, thus the control system will control the clutch to the opening cable and there will be no brake on the opening cable drive and thus no control may be provided for such a brake.

Having described the invention, modifications will be evident to those skilled in the art without departing from the spirit of the invention as defined in the appended claims.

I claim:

1. A cable operated machine comprising a prime mover, an openable and closeable working element, a haul back cable connected to said working element, a haul back drive means for reeling and unreeling said haul back cable, said haul back drive means including a haul back clutch and a haul back brake, an opening cable and a closing cable, an opening drive means for reeling and unreeling said opening cable, said opening drive means including an opening clutch and opening brake, a closing drive means for reeling and unreeling said closing cable, said closing drive means including a closing clutch and a closing brake, said opening cable and said closing cable being connected to said working element to move said element in a first direction when said opening and closing cables are being reeled and to open and close said working element on relative movement between said opening and closing cables, said haul back cable moving said working element in a second direction generally opposite to said first direction when said haul back cable is being reeled by said haul back drive means, a throttle control operative to vary the speed of said prime mover to adjust the amount of torque available to all of said drive means; a manual controller; said manual controller having a first sensor actuatable to provide an in signal for moving said working element in said first direction when said controller is displaced in one direction and to provide a haul back signal for moving said working element in said second direction when said controller is displaced in the direction opposite to said one direction, a second sensor to provide an up signal for raising said element when said manual controller is displaced in a third direction and a down signal to lower said working element when said manual controller is displaced in a direction opposite to said third direction, said manual controller also including sensor means to provide an open signal to open said working element on manipulation of said manual controller in a fourth direction and a close signal to close said working element on manipulation said manual controller in a fifth direction; a main computer means, means to deliver said signals from said sensors of said manual controller to said main computer means; said main computer means controlling said throttle control to vary the speed of said prime mover substantially in accordance with the maximum degree of displacement of said manual controller in said one, third or said directions opposite based on said signals from said manual controller; said main computer means when said main computer means receives said haul back signal controlling said haul back clutch to cause said haul back drive means to reel, said haul back break to release and adjustment of said closing cable brake to adjust a braking force applied by said closing brake to said closing drive means thereby to haul back said working element in said second direction; said main computer means when said main computer means receives said in signal controlling said closing clutch means to cause said closing drive means to reel, said closing cable, said closing brake to release and said haul back brake to apply a drag free on said haul back drive means; said main computer means controlling said brakes and said clutches to operate said drive means to extend the lengths of said cables between said drive means and said working element when said main computer means receives said down signal and controlling said clutches to operate said drive means and said brakes to shorten lengths of said cables between said drive means and said working element when said main computer means receives said up signal from said manual controller and said main computer means controlling said opening and closing clutches to control said opening and closing drive means respectively and said opening and said closing brakes to cause relative movement between said opening and said closing cables to open or close said working element when said main computer means receive an open or a close signal respectively from said manual controller.

* * * * *